US005417589A

United States Patent [19]

Terada

[11] Patent Number: 5,417,589

[45] Date of Patent: May 23, 1995

[54] LINKED ELECTRICAL CONNECTORS

[75] Inventor: Yoshihisa Terada, Yokkaichi, Japan

[73] Assignee: Sumitomo Wiring Systems, Ltd, Yokkaichi, Japan

[21] Appl. No.: 179,233

[22] Filed: Jan. 10, 1994

[30] Foreign Application Priority Data

Jan. 21, 1993 [JP] Japan ..... 5-001203 U
Jan. 21, 1993 [JP] Japan ..... 5-001204 U

[51] Int. Cl.[6] ..... H01R 9/00
[52] U.S. Cl. ..... 439/590; 439/885
[58] Field of Search ..... 439/590, 885

[56] References Cited

U.S. PATENT DOCUMENTS 3,325,769 6/1967 Travis ..... 439/590
3,345,599 10/1967 Henschen et al. .
4,072,376 2/1978 Shannon ..... 439/590
4,230,387 10/1980 Zahn ..... 439/590
4,391,482 7/1983 Czeschka ..... 439/590

FOREIGN PATENT DOCUMENTS 59-11425 4/1984 Japan .

OTHER PUBLICATIONS

English Language Translation of Japanese Utility Model Publication No. 59-11425.

*Primary Examiner*—Daniel W. Howell
*Attorney, Agent, or Firm*—Sandler Greenblum & Bernstein

[57] ABSTRACT

A linked electrical connector has a carrier formed with V-cuts. When a series of electrical connectors are separated by a cutter at V-cut portion, corners of the carrier are shaped as chamfered or curved surfaces. Thus, a linked electrical connector can be smoothly inserted in and removed from a connector box.

4 Claims, 9 Drawing Sheets

LINKED ELECTRICAL CONNECTORS

BACKGROUND OF THE INVENTION

1. Field of the invention

The present invention relates to a linked electrical connector, and specifically to linked electrical connectors used as plural connected electrical connectors in a common power supply circuit connected with fuses and installed in a motor vehicle. Common examples of such linked electrical connectors include joint boxes, relay boxes, and fuse boxes.

2. Description of the prior art

In an automotive fuse box as shown in FIGS. 14*a* and 14*b*, plural electrical connectors 1A, 1B and 1C (generally indicated as 1) to which fuses are separately connected are installed in individual terminal sockets 4 in the connector box 3. In each common power supply circuit, one electrical connector 1A is connected to the power supply via a wire 6, and jumpers 8 are used to short circuit (electrically connect) the one electrical connector 1A with the other electrical connectors 1B, 1C in the same power supply circuit.

As shown in FIG. 12, the common carrier 2 of the electrical connectors 1 is conventionally used for the jumpers 8.

The electrical connectors 1 are stamped from metal plate using a press, and the stamped plate is then bent and shaped to form a connector series in which the individual electrical connectors 1 formed in series at a uniform pitch are connected to a common carrier 2 at the wire crimping ends thereof.

The carrier 2 is cut appropriately so that the linked electrical connectors can be used in series of two electrical connectors 1A and 1B or three electrical connectors 1A, 1B and 1C according to the circuit design of the connector box 3.

FIGS. 12 and 13 show examples of a series of two linked electrical connectors 1A and 1B connected at the wire crimping end of the electrical connectors 1A and 1B to the carrier 2, which is then cut by a cutter 9. A series of three linked electrical connectors is similarly connected at the wire crimping end of the electrical connectors 1A, 1B and 1C to the carrier 2, which is then cut by a cutter 9.

The cut end of the carrier 2 in both the two and three linked electrical connectors series is a square end with square corners 2*a*. As a result, when inserted to the terminal sockets 4, or removed from the terminal sockets 4, of the connector box 3 as shown in FIGS. 14A and 14B, the square corners 2*a* will tend to catch the inside walls of the connector box 3 when the connectors become biased to the sides, thereby preventing smooth insertion or removal of the connectors.

As the number of electrical connectors 1 in a single series increases and a single wire must be held to insert or remove these plural connectors, it becomes even easier for the carrier 2 to become biased to the connector box 3 walls, and the square corners 2*a* catch even more easily.

SUMMARY OF THE INVENTION

Therefore, an object of the present invention is to provide a linked electrical connector that enables smooth insertion to and removal from the connector box of the linked electrical connector series.

To achieve this object, a linked electrical connector according to the present invention comprises plural electrical connectors formed in series at a uniform pitch on a carrier with the carrier cut at appropriate positions to link plural electrical connectors in series, and is characterized by the cut corners of the carrier being chamfered or curved.

The cutting operation providing the cut corners of the carrier can be executed during formation of the linked electrical connectors series, or during crimping of the wires to each of the electrical connectors.

In a linked electrical connector according to the present invention, the corners of the cut ends of the carrier are cut using a cutter during the electrical connector carrier cutting process to form a chamfered face or a curved face. As a result, the chamfered or curved faces of the carrier will not catch the inside wall of the connector box when the carrier becomes biased to said walls during insertion to or removal from the connector box, and these operations can be completed smoothly.

BRIEF DESCRIPTION OF THE DRAWINGS

The present invention will become more fully understood from the detailed description given below and the accompanying diagrams wherein.

DESCRIPTION OF PREFERRED EMBODIMENTS

The preferred embodiments of the present invention are described below with reference to the accompanying figures.

Figure 1:
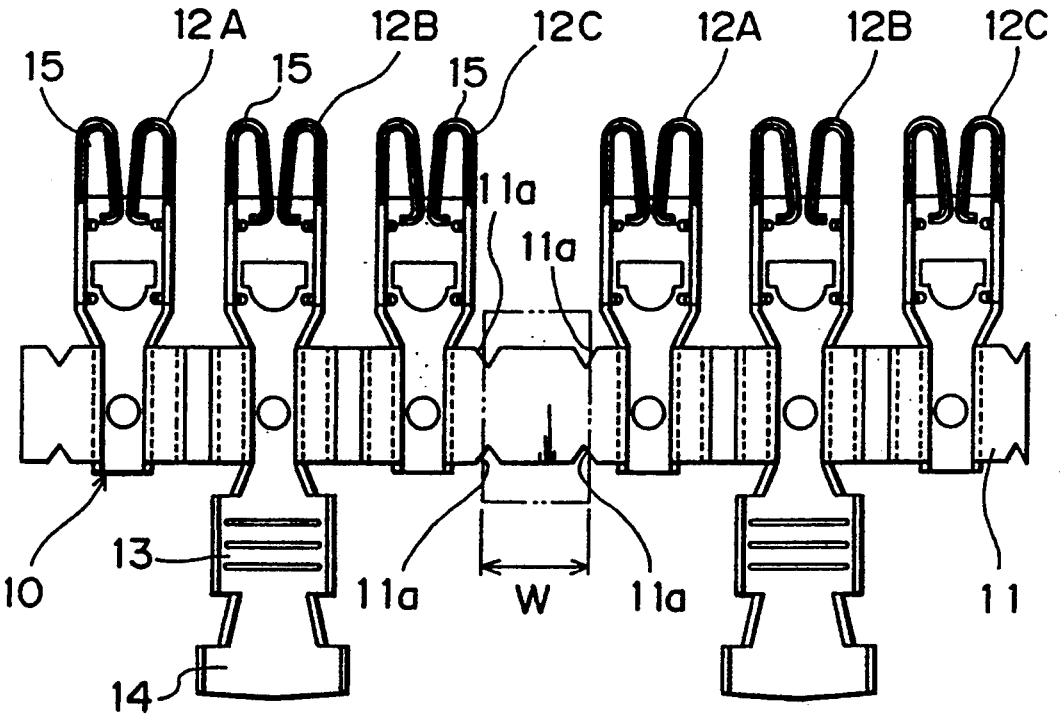
FIG. 1 is a plan view of a series of three linked electrical connectors according to the first embodiment of the invention.

A series of three linked electrical connectors 10 according to the first embodiment is shown in FIG. 1. As shown in FIG. 1, a single metal plate is stamped in a press to form the electrical connectors 12A, 12B and 12C in series at a constant pitch along the length of the carrier 11 at the middle of the connectors.

In this series of three electrical connectors 12A–12C, a wire barrel 13, insulation barrel 14, and electrical contacts 15 are formed in the center connector 12B by bending, and electrical contacts 15 are formed in the side connectors 12A and 12C by bending.

Between the two series of three connectors, the opposite sides of the carrier 11 is formed with V-cuts 11*a* to provide chamfers in a manner described later.

The carrier is bent between connectors 12A and 12B and between 12B and 12C to reduce the pitch, but the carrier is not bent between the end connectors 12A and 12C of different series, and is therefore left at a greater width W.

Figure 2:
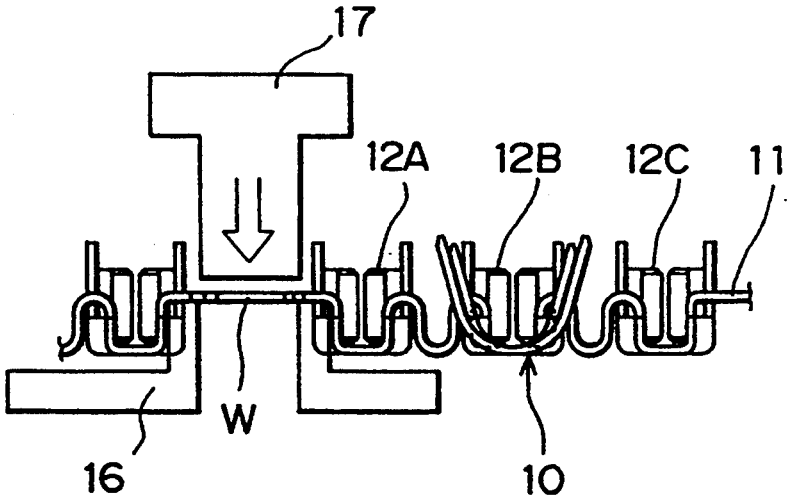
FIG. 2 is a front view of the cutting operation for separating the series of linked electrical connectors shown in FIG. 1, FIG. 3 an oblique view of the connector box and linked electrical connectors.

As shown in FIG. 2, this wide part W of the carrier 11 is placed on the stand 16 during the carrier 11 cutting process, and is cut from above by a cutter 17.

The shape of the cutter 17 is designed to leave either chamfered or curved faces on the cut corners 11*a* of the carrier 11.

Figure 5A:
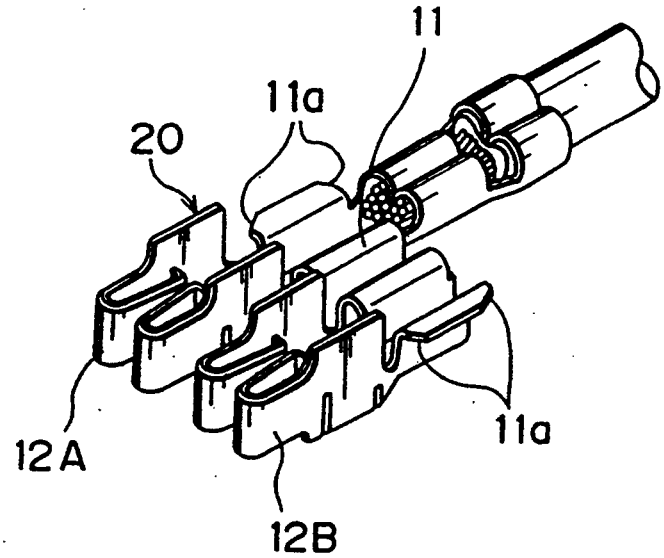
FIGS. 5*a* and 5*b* are oblique views of a series of two linked electrical connectors, and a series of three linked electrical connectors, respectively.
Figure 5B:
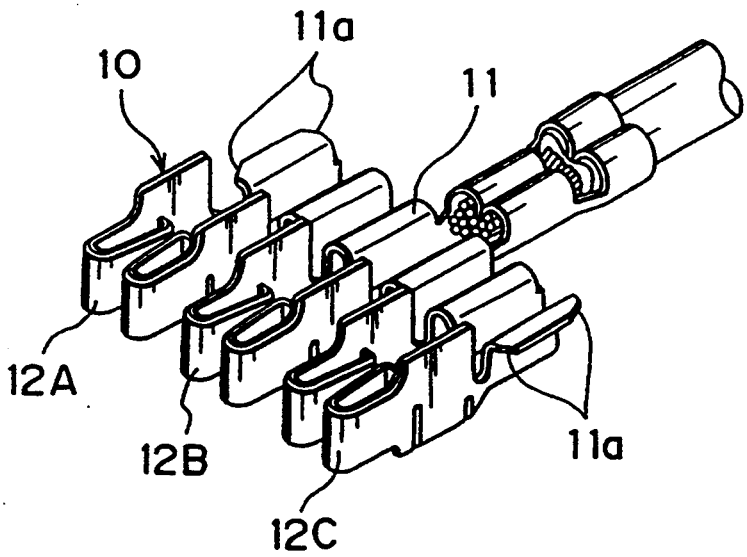

As a result, all four corners 11*a* on both ends of the cut carrier 11 in this series of three linked electrical connectors 10 are chamfered or curved as shown in FIG. 5*b*. It should also be noted that the four corners 11*a* on both ends of the cut carrier 11 in a series of two linked electrical connectors 20 are also chamfered or curved as shown in FIG. 5*a*.

The cutting step providing chamfered faces to the carrier 11 corners 11*a* is executed before the wire crimping step in the embodiment shown in FIG. 1 to form the series of two or three electrical connectors.

In addition, the wire is crimped only to the one electrical connector having the wire barrel 13 and insulation barrel 14 in the series of three or two linked electrical connectors 10, 20.

It should also be noted that it is not necessary to cut the carrier 11 during the linked electrical connector stamping process, and the carrier 11 can be cut to provide the chamfered faces during the wire crimping step.

Figure 3:
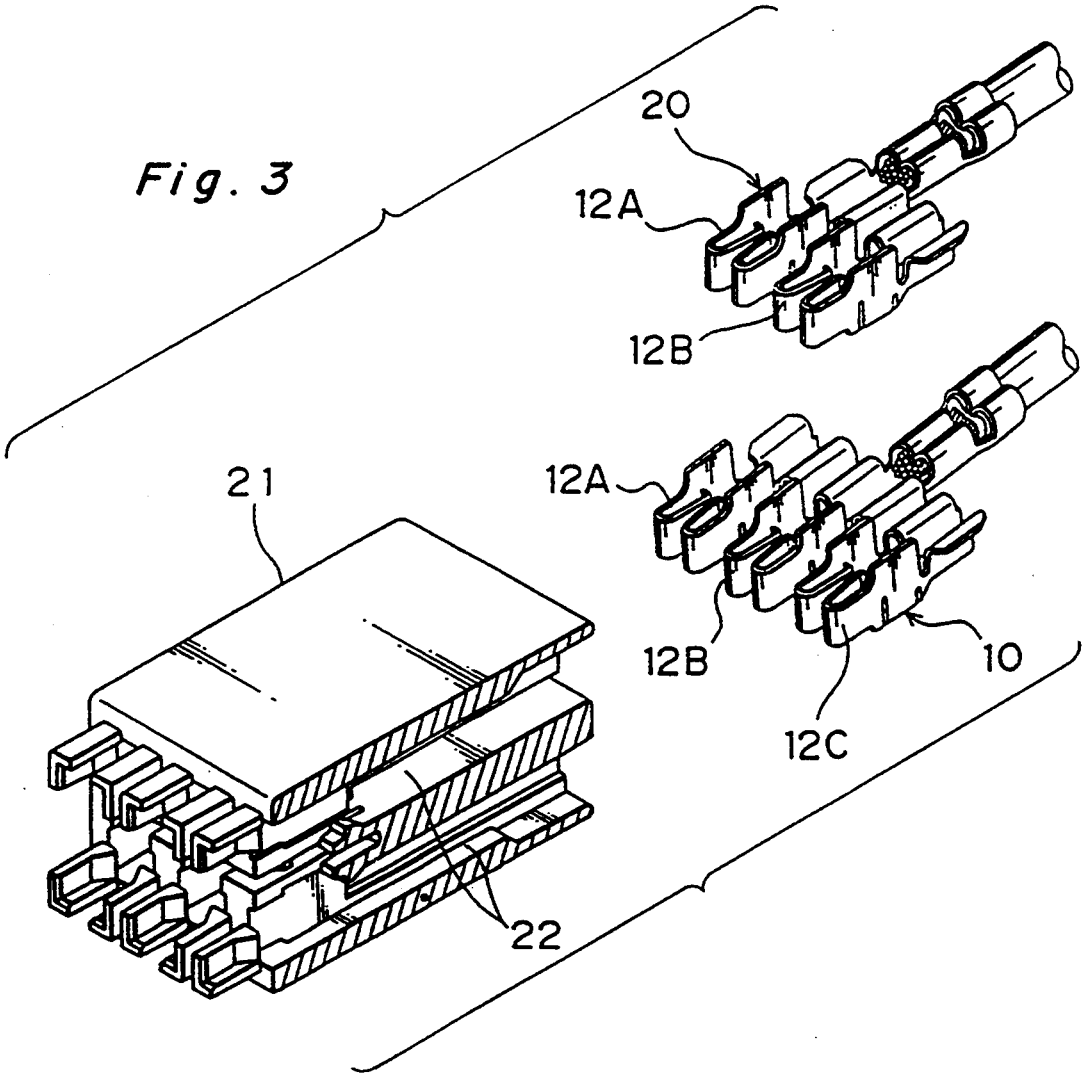
Figure 4:
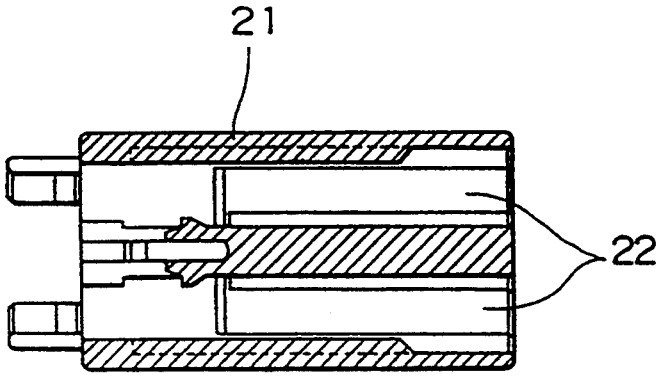
FIG. 4 is a cross section of the connector box.

As shown in FIGS. 3 and 4, the series of three or two linked electrical connectors 10 and 20 is then inserted to the terminal sockets 22 of the connector box 21.

Figure 6A:
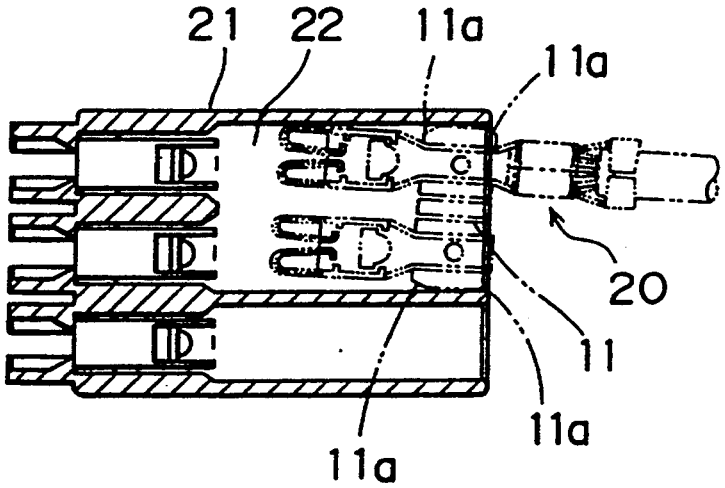
FIGS. 6*a* and 6*b* are plan views showing insertion of a series of two linked electrical connectors, and a series of three linked electrical connectors, respectively.
Figure 6B:
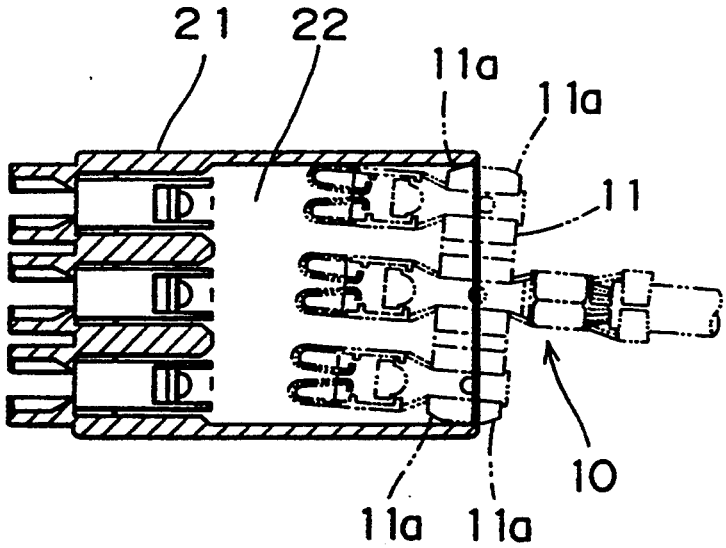

When the series of two linked electrical connectors 20 is inserted to or removed from the connector box 21 terminal sockets 22 as shown in FIG. 6*a*, or when the series of three linked electrical connectors 10 inserted to or removed from the connector box 21 terminal sockets 22 as shown in FIG. 6*b*, the chamfers or curves provided on the cut corners 11*a* of the carrier 11 do not catch the inside walls of the connector box 21 even if the carrier 11 becomes biased to the walls, and both insertion and removal operations can be completed smoothly.

In addition, a carrier 11 in which the corners 11*a* are curved is particularly effective with connectors of many electrical connectors 12 in series where the carrier 11 is easily deformed, and with connectors connected at the center to the carrier 11 and inserted to or removed from the connector box 21 through a long stroke.

Figure 7:
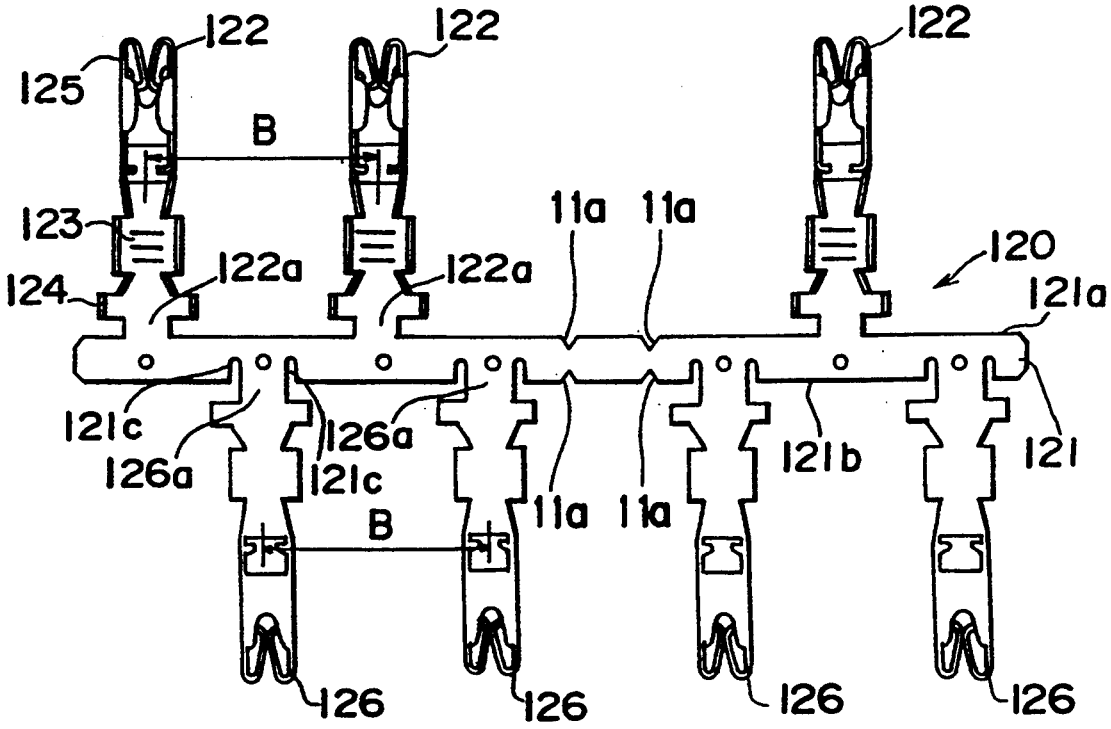
FIGS. 7 and 8 are plan views of a series of four linked electrical connectors and three linked electrical connectors according to the second embodiment of the invention, respectively showing before and after carrier bending.
Figure 8:
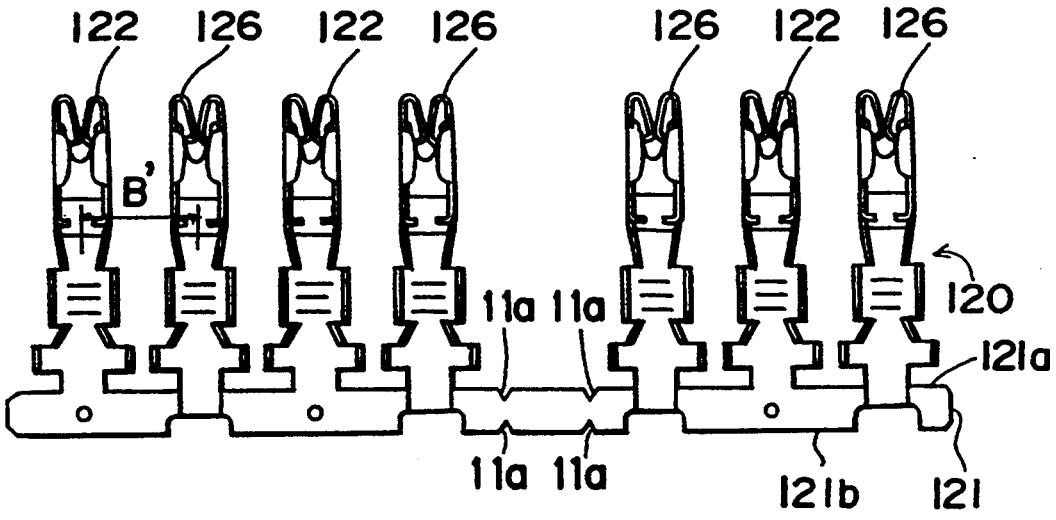

Referring to FIGS. 7 and 8, a linked electrical 10 connector 120 according to a second embodiment is shown. As shown in FIG. 7, a single metal plate is stamped in a press to form first linked electrical connectors 122 on one side 121*a* (the top in FIG. 7) of a narrow carrier 121, and a second linked electrical connectors 126 on the other side 121*b* (the bottom in FIG. 7) of the carrier 121. A series of four linked electrical connectors and three linked electrical connectors are connected by a common carrier 121.

Between the two series of four linked connectors and three linked connectors, the opposite sides of the carrier 11 is formed with V-cuts 11*a* to provide chamfers in the same manner as that in the first embodiment.

The first linked electrical connectors 122 are connected to the carrier 121 at the wire crimping end 122*a* thereof at a constant pitch B along the carrier 121 length. A wire barrel 123, insulation barrel 124, and electrical contacts 125 are formed in the normal front of each of the first linked electrical connectors 122 by bending.

Figure 11:
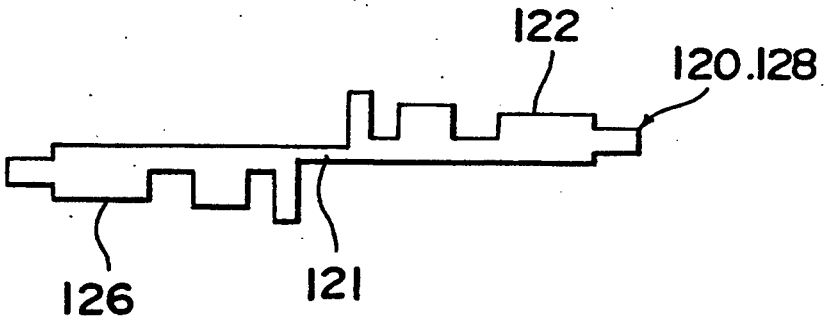
FIG. 11 is a side view of the linked electrical connector of the second and third embodiments before bending.
Figure 12:
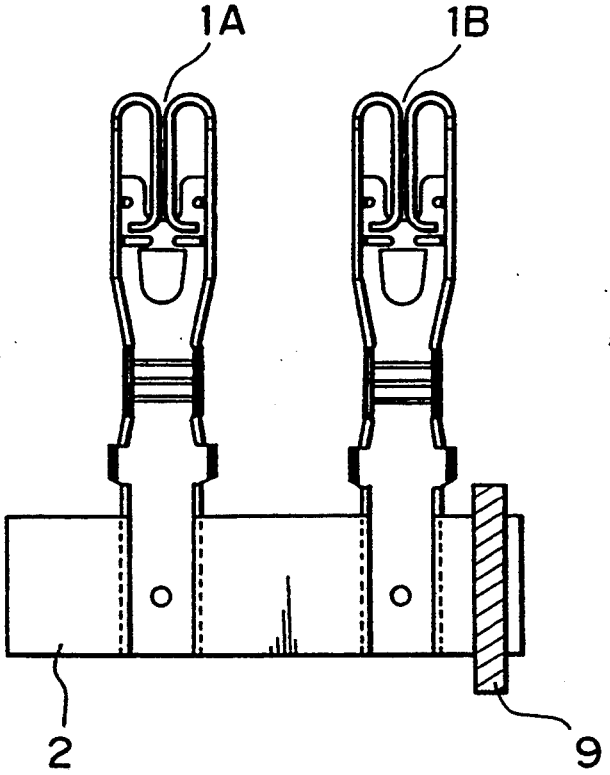
Fig. 12 PRIOR ART
FIGS. 12 and 13 are plan views of the cutting operation in a conventional series of two linked electrical connectors.
Figure 13:
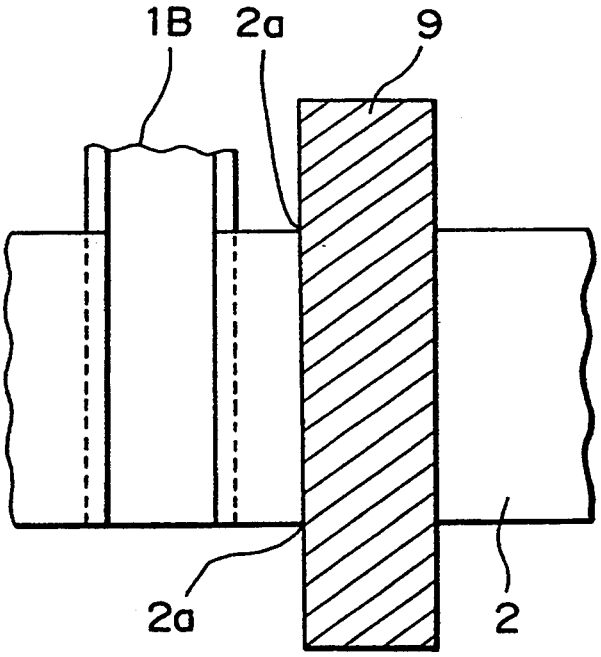
Fig. 13 PRIOR ART
Figure 14A:
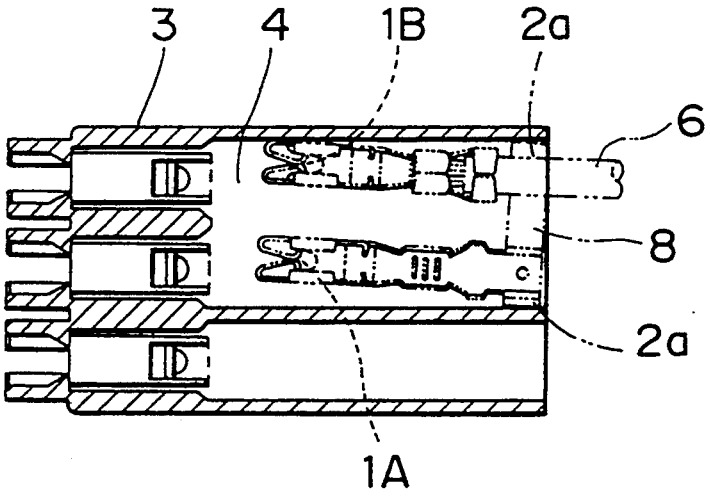
Fig. 14a PRIOR ART
FIGS. 14*a* and 14*b* are plan views showing insertion of a series of two linked electrical connectors, and insertion of a series of three linked electrical connectors, respectively.
Figure 14B:
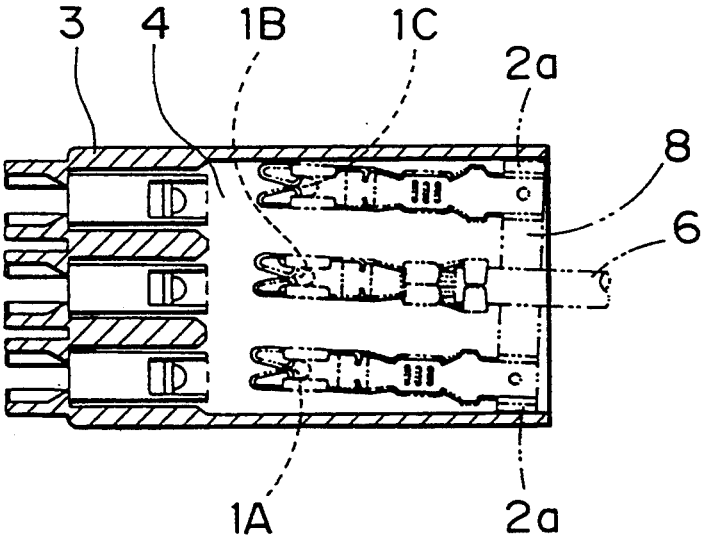
Fig. 14b PRIOR ART

The second linked electrical connectors 126 are similarly connected to the carrier 121 at the wire crimping end 126*a* thereof at the same constant pitch B along the carrier 121 length. The second linked electrical connectors 126, however, are offset by one-half pitch B to the first linked electrical connectors 122. As with the first linked electrical connectors 122, a wire barrel 123, insulation barrel 124, and electrical contacts 125 are also formed in the second linked electrical connectors 126, but are formed on the side opposite that to which they are formed on the first linked electrical connectors 122, as shown in FIG. 11.

Notches 121*c* extending to the center of the width of the carrier 121 are also formed on the other side 121*b* of the carrier 121 on both sides of the base end 126*a* of each second linked electrical connector 126.

At around the last step of the linked electrical connector 120 manufacturing process, each of the second linked electrical connectors 126 formed on the other side 121*b* of the carrier 121 is inverted 180 degrees from the base of the notches 121*c* (near the center of the carrier 121 width) to the one side 121*a*. As a result, the first linked electrical connectors 122 and second linked electrical connectors 126 form a single connector series on the one side 121*a* of the carrier 121 with the face of each connector facing the same direction as shown in FIG. 8. The pitch B′ between adjacent first and second linked electrical connectors 122,126 is one-half pitch B of the stamping, and equal to pitch A of the terminal sockets 22 in the connector box 21.

The carrier 121 is cut in the above described manner to provide series of four connectors and three connectors. The number connectors in one series can be other than four or three, such as two according to the circuit design of the connector box 21.

As will be obvious from the above description, according to the second embodiment, it is possible to eliminate the step for bending the carrier in a U-shape as required in the first embodiment to reduce the pitch B′ of the electrical connectors 122, 126 to half of pitch B. In addition, because the carrier 121 can be simply folded over through part of the carrier 121 width, special shaping dies or processes are unnecessary.

Carrier 121 strength is also increased because the carrier 121 is doubled in parts. The carrier 121 is also more resistant to deformation by external forces, and to compression, stretching, and deflection side-to-side. The dimensional stability of the carrier 121 and linked electrical connector 120 is therefore improved.

Furthermore, according to the second embodiment, it is also easier to wind the linked electrical connector 120 to a reel because the carrier 121 will not stretch or compress along the length thereof.

Figure 9:
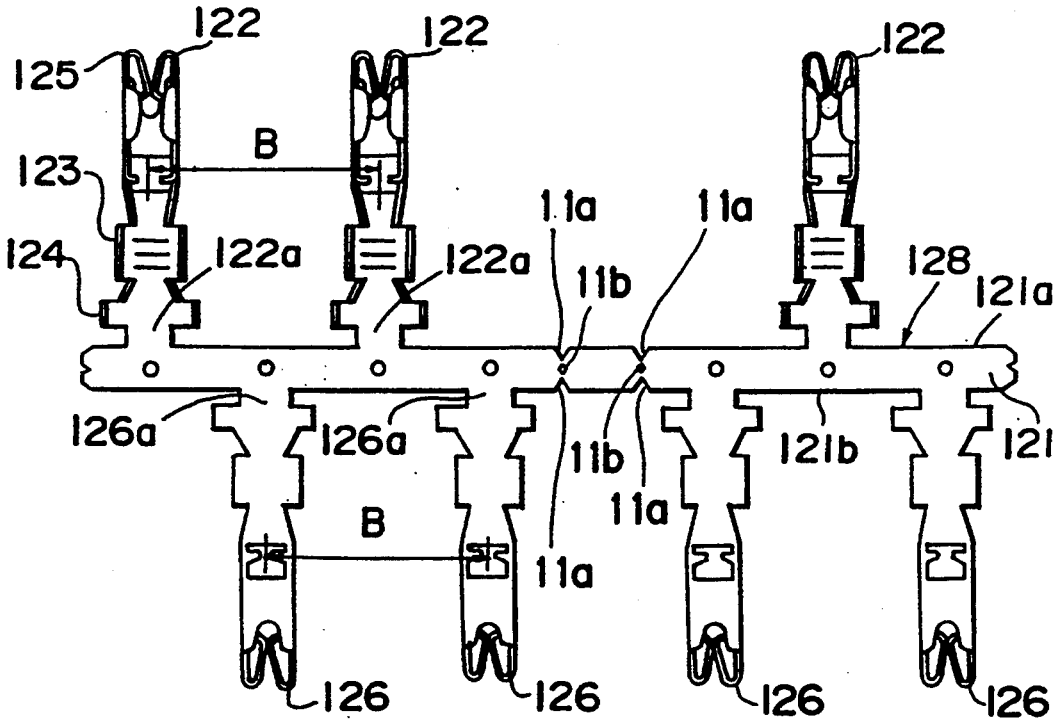
FIGS. 9 and 10 are plan views of a series of four linked electrical connectors and three linked electrical connectors according to the third embodiment of the invention, particularly showing before and after carrier bending.
Figure 10:
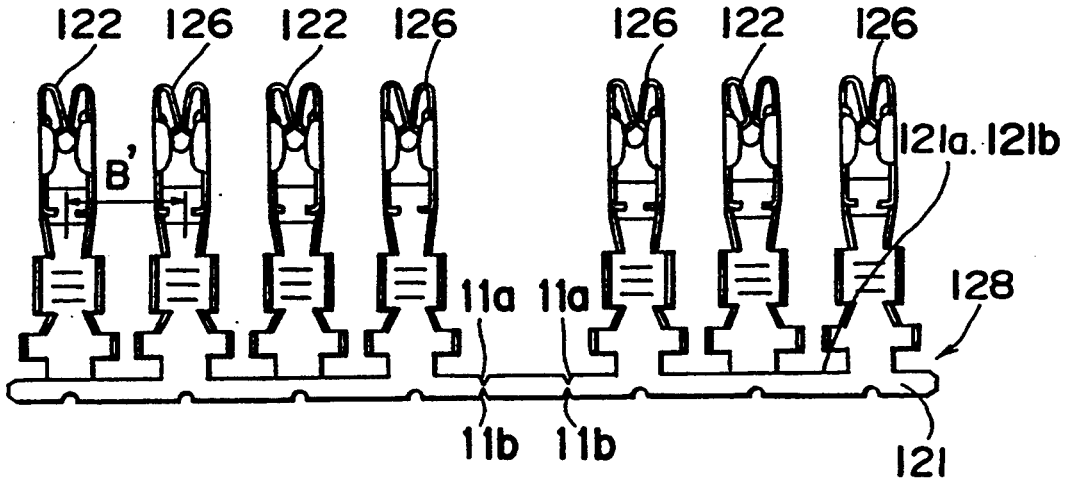

A linked electrical connector 128 according to a third embodiment of the invention is shown in FIGS. 9 and 10.

In addition to the V-cuts 11*a*, a rhombus opening 11b is formed at the center of the carrier 121 width, i.e., between the V-cuts 11*a* at opposite sides to provide chamfers in a similar manner to that in the first embodiment.

The first and second linked electrical connectors 122, 126 are shaped as in the second embodiment above, but the notches 121*c* to the center of the carrier 121 width on each side of the second linked electrical connectors 126 ends 126*a* are not formed.

As a result, the second linked electrical connectors 126 formed on the other side 121*b* of the carrier 121 are inverted 180 degrees to the one side 121*a* from the width-wise center of the carrier 121 in the third embodiment. Because the carrier 121 is doubled from the center along the full length thereof in the third embodiment, carrier 121 strength is even greater. The other effects and benefits of this design are the same as those of the linked electrical connector 120 according to the second embodiment above.

As will be obvious from the above description, the cut corners of the carrier in a linked electrical connector according to the present invention are shaped with a cutter to form chamfered or curved faces during the electrical connector carrier cutting step. As a result, these chamfered or curved corners will not catch on the walls of the connector box even if the carrier becomes biased to the walls during insertion or removal, and these operations can be completed smoothly.

Furthermore, according to the second and third embodiments, a linked electrical connector can reduce the pitch between the linked electrical connectors by one-half because the second linked electrical connectors formed on the other side of the carrier are inverted 180 degrees to the first side of the carrier to form a single series of first and second linked electrical connectors on the same side of the carrier. In addition, because the linked electrical connector can be formed by folding the carrier over in two through the carrier width along part or the full length of the carrier, special shaping dies and processes are unnecessary, and the manufacturing cost can be reduced.

In addition, strength is improved because the carrier is doubled over, making the carrier more resistant to deformation by external forces, eliminating side-to-side stretching, compression, and deflection, improving dimensional stability, and enabling easier reel winding.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A linked electrical connector comprising:

a carrier made of electrically conductive material;

electrical connectors connected at least on one side of said carrier in series at a uniform pitch;

said carrier formed with V-cuts on opposite sides thereof at each end of said series of electrical connectors whereby cut edges of the carrier at said V-cuts are chamfered.

2. A linked electrical connector as claimed in claim 1, wherein said electrical connectors comprise:

first group electrical connectors connected on a first side of said carrier in series at twice said uniform pitch;

second group electrical connectors connected on a second side of said carrier formed with the tops and bottoms thereof opposite those of the first group electrical connectors, and in series at said twice said uniform pitch but offset said pitch from the first group electrical connectors, whereby when said carrier, at least portions from which said second group electrical connectors are extending, are folded in half widthwise to rotate the second group electrical connectors 180 degrees to the other side of the carrier, the first group electrical connectors and the second group electrical connectors occur alternately at said uniform-pitch on said first side of said carrier.

3. A linked electrical connector as claimed in claim 1, wherein one connector in said series of connectors is formed with an electrical wire crimping means.

4. A linked electrical connector as claimed in claim 1, wherein each connector in said series of connectors is formed with an electrical wire crimping means.

* * * * *